US005857239A

United States Patent [19]

Oh et al.

[11] Patent Number: 5,857,239

[45] Date of Patent: Jan. 12, 1999

[54] VACUUM CLEANER HAVING A WET DUSTER DEVICE

[75] Inventors: Jang Keun Oh; Woo Yong Park, both of Kwanju, Rep. of Korea

[73] Assignee: Kwanju Electronics Co., Ltd., Rep. of Korea

[21] Appl. No.: 580,313

[22] Filed: Dec. 28, 1995

[30] Foreign Application Priority Data

| | | | |
|---|---|---|---|
| Dec. 31, 1994 | [KR] | Rep. of Korea | 1994 39659 |
| Jan. 10, 1995 | [KR] | Rep. of Korea | 1995 285 |
| Jan. 16, 1995 | [KR] | Rep. of Korea | 1995 564 |

[51] Int. Cl.[6] ..... A47L 11/28

[52] U.S. Cl. ..... 15/321; 15/99; 15/322

[58] Field of Search ..... 15/320, 321, 322, 15/377, 99

[56] References Cited

U.S. PATENT DOCUMENTS

| | | | |
|---|---|---|---|
| 3,916,470 | 11/1975 | May | 15/99 X |
| 4,433,451 | 2/1984 | Parisi | 15/322 X |
| 4,562,610 | 1/1986 | Davis et al. | 15/99 X |
| 4,696,074 | 9/1987 | Cavalli | 15/322 X |
| 4,845,794 | 7/1989 | Korski et al. | 15/320 X |
| 5,241,724 | 9/1993 | Lim | 15/322 |
| 5,398,373 | 3/1995 | Blase et al. | 15/377 X |

*Primary Examiner*—Chris K. Moore
*Attorney, Agent, or Firm*—Irving Keschner

[57] ABSTRACT

A vacuum cleaner comprising a moisture cleaner device which is easily attached and removed. The moisture cleaner device comprises a frame providing the circulation track of the moisture cleaner; a working roller and a driven roller mounted sideways in the top and lower part of the said frame; a first coupling means for attachment and removal of the lower part of the moisture cleaner to the vacuum suction head section; a second coupling means for attachment and removal of the top part of the moisture cleaner to a connecting pipe; and a moisture cleaner mounted to the surface of the frame. Because the peripheral surface of the working roller is uneven, when the vacuum suction head portion is moved back and forth, the working roller and driven roller are rotated, the moisture cleaner thus being operative such that the moisture cleaner contacts the floor as the normal vacuum suction cleaning proceeds.

6 Claims, 8 Drawing Sheets

VACUUM CLEANER HAVING A WET DUSTER DEVICE

FIELD OF THE INVENTION

This invention relates to a vacuum cleaner that has a loop-styled moisture cleaner device which is easy to attach and detach, and which is easy to rotate, so that it is possible to conduct vacuum and wet cleaning.

BACKGROUND OF THE INVENTION

As shown in FIG. 1, the conventional vacuum cleaner is composed of a primary body 1 that accommodates both a motor fan 2 and a cinder catching filter 3, and that induces vacuum produced suction; a device 10 that forms a dust suction hole 11 at the bottom of the primary body 1 and that collects fragments and dust on a floor; and a connecting pipe 15 connecting the primary body 1 to the device 10.

In the conventional vacuum cleaner, if the interior part of the cinder catching filter 3 is set to a vacuum situation by operating motor fan 2, dust and fragments on the floor are gathered with air through the connecting pipe 15. Afterward, the dust and fragments are filtered through cinder catching filter 3, and only pure air is exhausted through an outlet 4 located at the back of primary body 1.

However, by sucking up the surrounding air, the vacuum cleaner is only able to remove the dust and the fragments on the floor while leaving behind muck and spots on the floor.

In order to remove muck and spots as well as dust and fragments, a moisture, or wet, type cleaner is typically used after one uses a separate vacuum cleaner. However, the additional cleaning step of using a separate moisture type cleaning device afterwards in order to maintain a clean floor is an unnecessary annoyance. When cleaning a large area, in particular, this extra step is time consuming and unnecessary.

Recently, several devices have been developed centering on the vacuum cleaner in which a towel or a sponge is affixed to the device 10, making it possible to clean a floor by using a vacuum cleaner and a moisture cleaning device at the same time.

FIGS. 2A to FIG. 2C are side sectional views of a device 10 that is mounted to various kinds of moisture cleaning devices.

FIG. 2A shows a moisture cleaning device disclosed in Korea Utility Model No. 93-25020. The device comprises a structure in which the roller moisture cleaner is wrapped around the peripheral surface of the rotation axis 21 located at the center of the device 10. Therefore, if device 10 is moved back and forth, the roller moisture cleaner 20 rotates and rubs the floor. Therefore, at the same time that the spots or muck are removed, dust and fragments are sucked up though the dust suction hole 11 positioned at the front and rear of moisture cleaner 20.

FIG. 2B is a moisture cleaner device disclosed in Korea Patent Publication No. 94-10754. The moisture cleaner device operates by the connection of a roller moisture cleaner 25 to a working motor 24 by a belt 26. The working motor 24 is operated by an operating switch 27 that connects and shorts the power according to the movement of device 10. As shown in FIG. 2B, when device 10 is moved forward, the operating switch 27 is converted to the right direction, and power is sent to a driving motor 24. Rotation of belt 26 causes the roller shaped moisture cleaner 25 to rotate and the clean side of the moisture cleaner device 25 rubs the floor.

On the other hand, when device 10 is moved backwards, the operating switch 27 is converted to the left direction and power is broken, so the driving motor 24 ceases to operate. FIG. 2C is a moisture cleaning device disclosed in Korea Patent No. 94-2584, Unlike the roller-styled moisture cleaners shown in FIG. 2A and FIG. 2B, a belt-styled moisture cleaner 32 is used. The liquid cleaner 32 comprises a belt styled moisture cleaner 32 rolled around a pair of rollers 31 and 31'; a driving motor 30; and a pair of transferring rollers 33 and 33' which transfer the driving power of the driving motor 30 to the belt-styled moisture cleaner 32, and which accommodate the device 10. The dust suction hole 11 is located at the front of moisture cleaner 32. If the driving motor 30 is operated, the transferring rollers 33 and 33' are rotated, the belt-styled moisture cleaner 32 is rotated in one direction, whereby the floor is rubbed removing the spots and muck.

The above-mentioned moisture cleaner devices enlarge the size of device 10 since the moisture cleaner devices are positioned in the interior part of device 10. Therefore, the handling of device 10 is difficult and dust intake on the corner is impossible during the cleaning. In addition, device 10 does not allow the user to operate only the dust intake if desired, the moisture cleaner operating in conjunction with the dust intake due to the structure of the prior art devices.

Moreover, the used moisture cleaner must be removed and replaced by a clean moisture cleaner, a difficult procedure in view of the structure of the above prior art devices. In essence, the moisture cleaner structure and function is dictated by the size of device 10, the structure of the prior art being complex which increases the cost of device 10.

SUMMARY OF THE INVENTION

In view of the foregoing, it is an object of the invention to provide a vacuum cleaner having a moisture cleaner device in which the structure is simple and relatively small.

Another object of this invention is to provide a vacuum cleaner which can utilize various kinds of the moisture cleaners without changing the structure of the device 10.

In accordance with the present invention, a vacuum cleaner having a moisture cleaner component comprises a primary body accommodating a motor fan and a cinder catching filter and utilizes an air vacuum; a suction dust hole at the bottom of the body and sucking up dust on the floor; and a pipe connecting the primary body with the suction dust hole, in which a top part and a lower part of the moisture cleaner are easily attached to and removed from the connecting pipe and the suction dust hole.

The moisture cleaning device comprises a frame for providing the circulation track for the moisture cleaner; a working roller mounting sideways in the lower part of the frame; a driven roller mounting sideways in the top part of the frame; first coupling means for attachment and removal of the lower part of the moisture cleaner to the suction dust hole; second coupling means for attachment and removal of the top part of the moisture cleaner to the connecting pipe. The top and lower part of the frame are composed of a hinge member mounted sideways in the center of the frame for easier attachment and removal of the moisture cleaner, the hinge member allowing the moisture device to be folded and flattened.

The peripheral surface of the cylindrical shaped working roller is uneven such that the moisture cleaner moves around between the working roller and the driven roller.

The first coupling means comprises a projection member which projects from both sides of the lower part of the frame, and has a cut cylinder shape so that the top part edge has a semicircle cross-sectional shape and a groove part formed at the suction dust hold in order to accommodate the projection member, the groove part being composed of an open groove part in which the length of the width is larger than the semicircle length of the top part edge, and an interior groove part in which the length of the width is larger than the diameter of the top part edge, whereby the top part edge of the projection member passes through the open groove of the groove part in the state of the standing and then, the part edge is moved down the interior groove such that the lower part of the frame allows the attachment and removal of the dust suction hole easily.

The second coupling means is composed of a coupling projection formed at the top part side of the frame and an expansive band formed with coupling holes at both edges thereof in order to be inserted into the coupling projection, whereby the coupling projection is inserted into the coupling hole such that the top part of the frame is mounted with the connecting pipe freely removable while the band is enclosed with the front of the connecting pipe.

When the vacuum cleaner having the moisture cleaner is moved back and forth, the dust and fragments are sucked in through the dust suction hole and the driven roller is rotated at the same time, the moisture cleaner rubbing the floor. As shown in FIG. 3, the present invention comprises the conventional vacuum cleaner with the moisture cleaner attached thereto extending a direction along the axis of the connecting pipe.

BRIEF DESCRIPTION OF THE DRAWINGS

Other features and advantages of the invention will appear from the following description in which the preferred embodiments have been set forth in detail, in conjunction with the accompanying drawings.

DETAILED DESCRIPTION OF THE PREFERRED EMBODIMENTS

Figure 1:
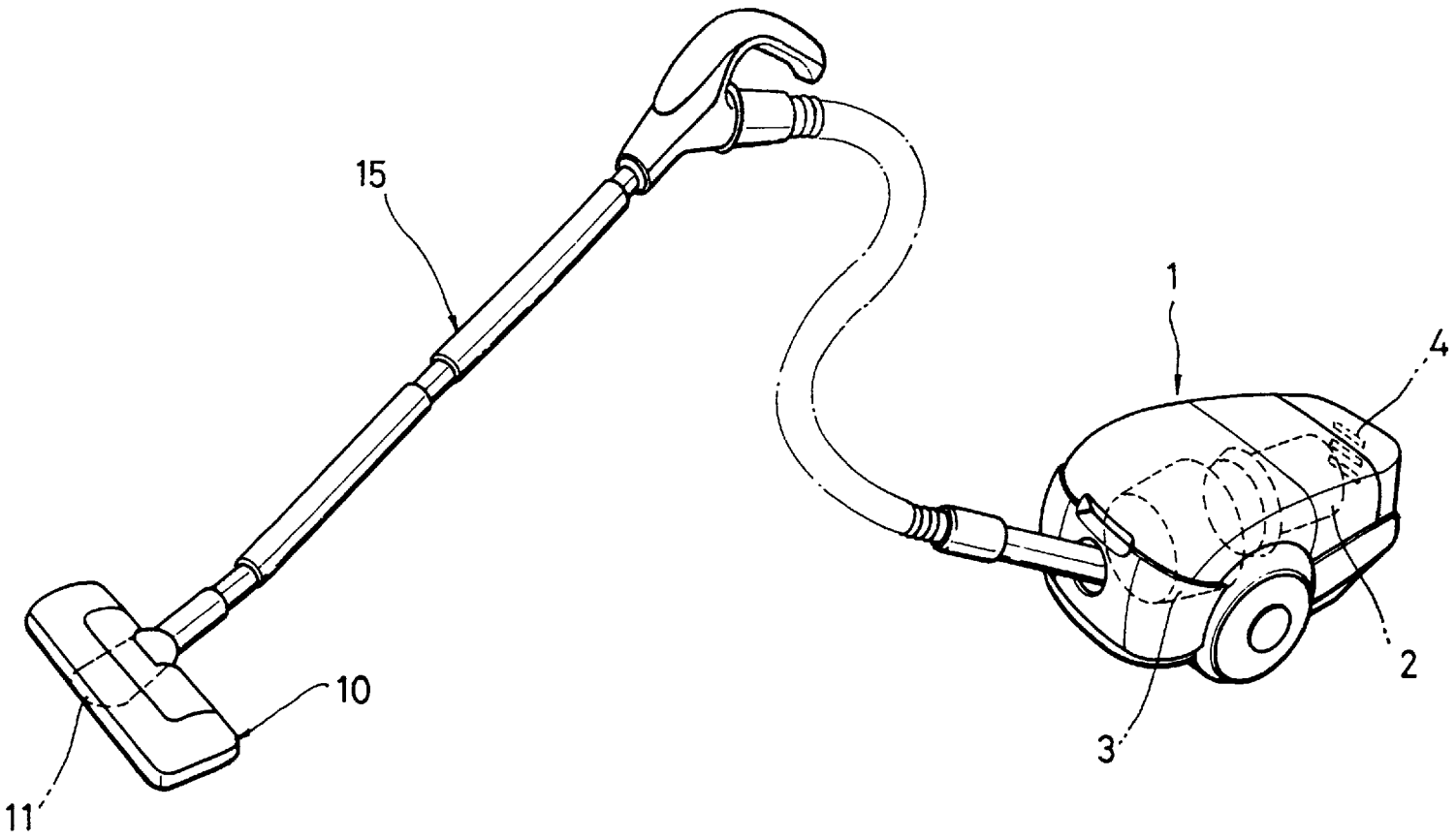
FIG. 1 is a perspective view of a conventional vacuum cleaner.
Figure 2A:
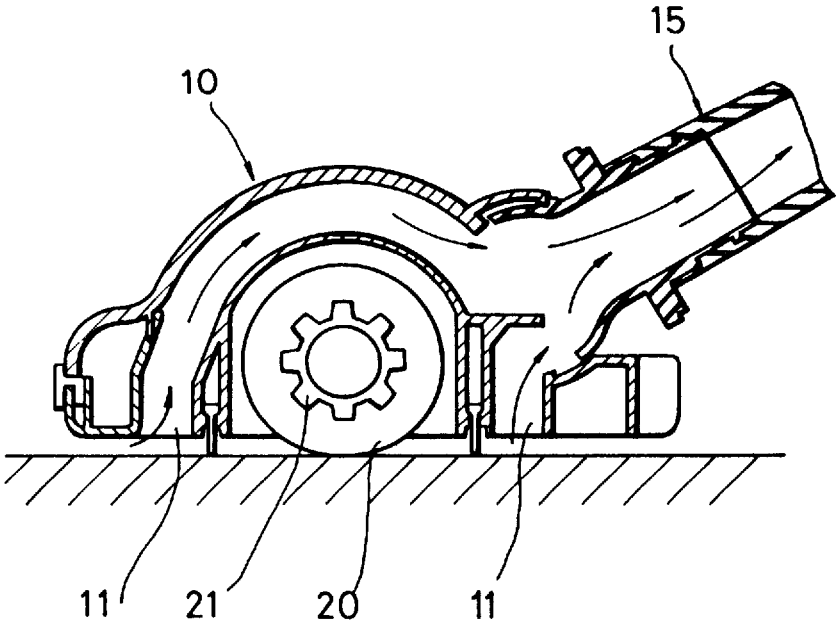
FIG. 2A to FIG. 2C are side sectional views illustrating various kinds of prior art moisture cleaning devices incorporated in the vacuum cleaner.
Figure 2B:
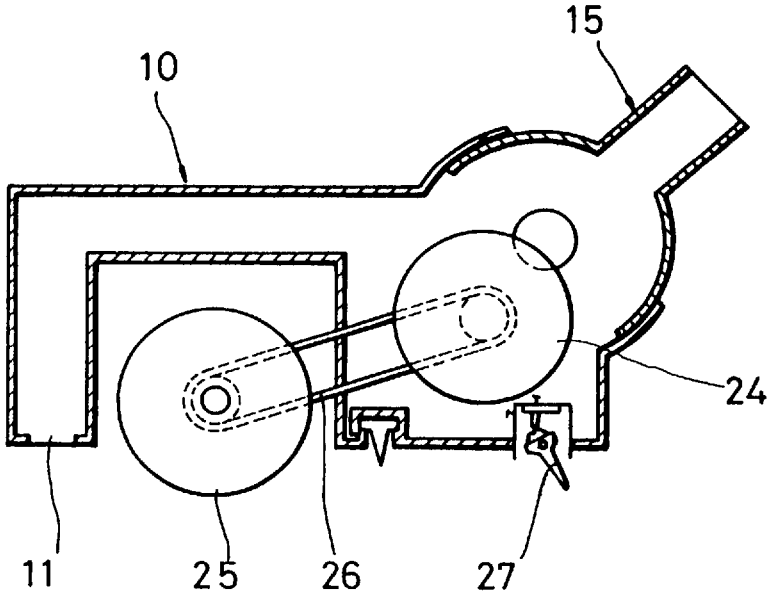
Figure 2C:
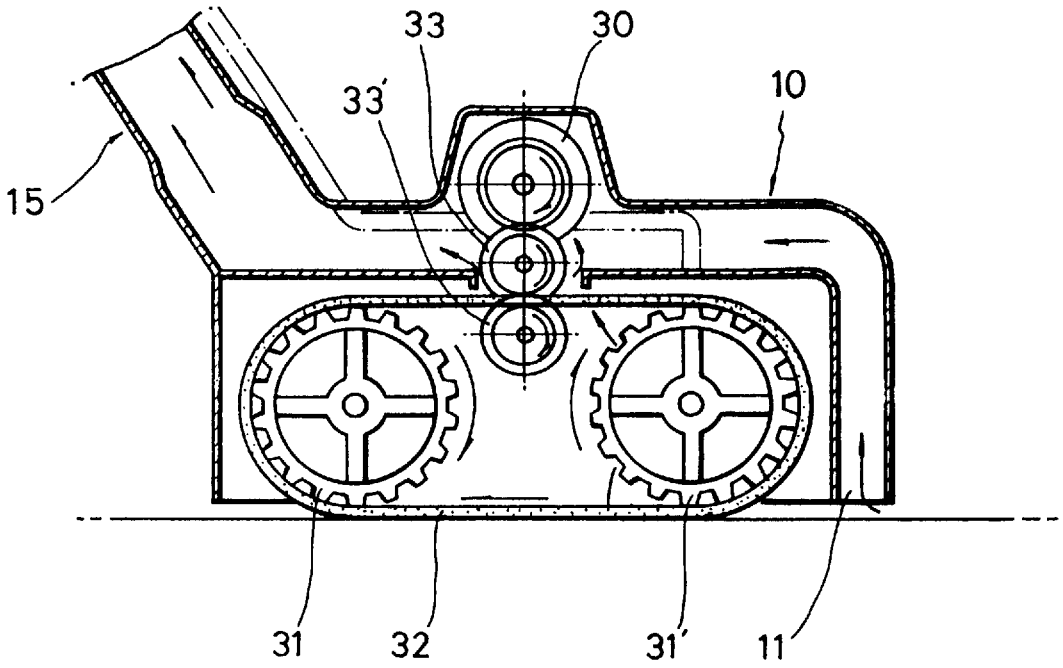
Figure 3:
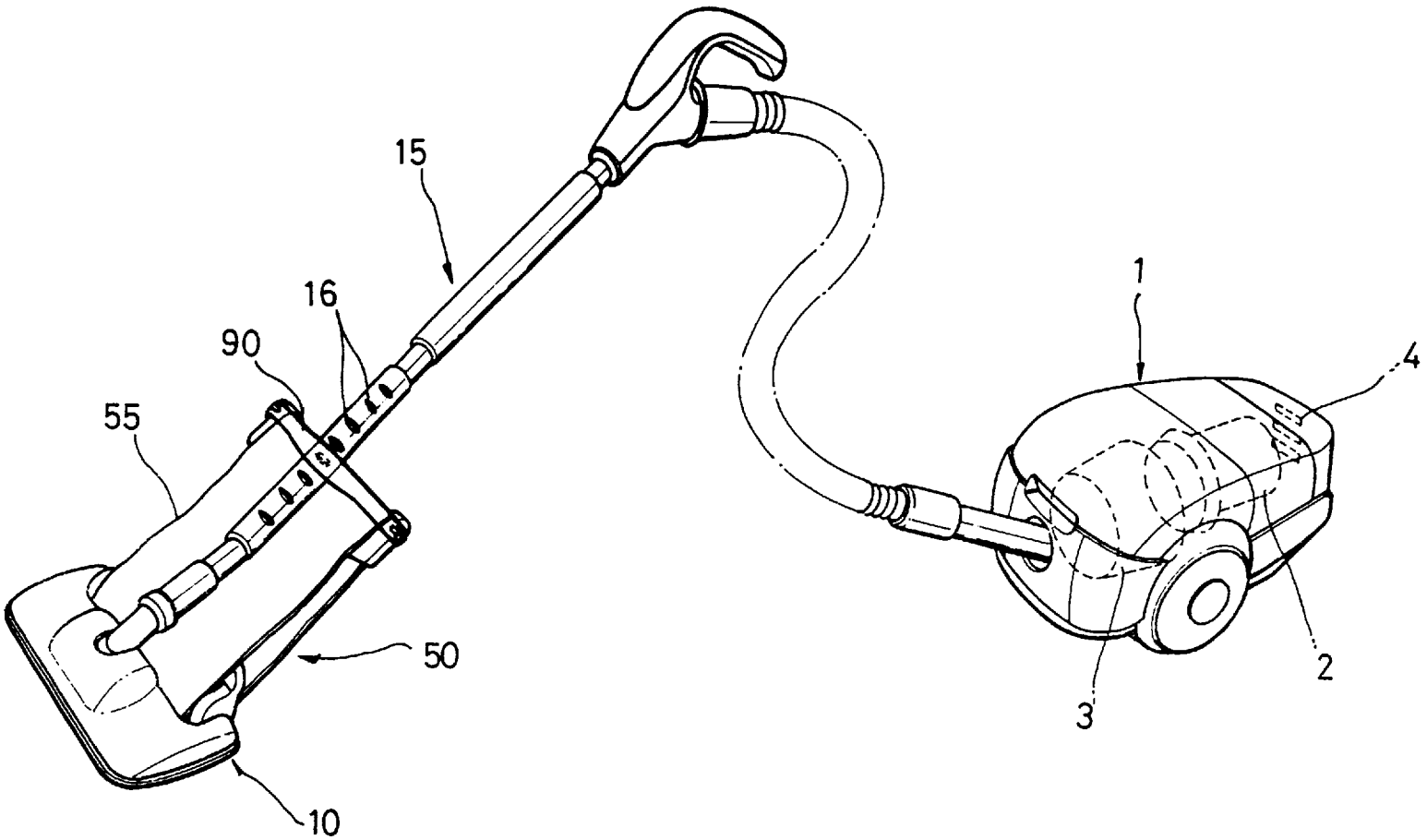
FIG. 3 is a perspective view of a vacuum cleaner having the moisture cleaner device in accordance with the present invention.

As shown in FIG. 3, the present invention comprises moisture cleaner device 50 which is attached to a conventional vacuum cleaner. The lower part of the moisture cleaner device 50 is easily attachable and removable from the back of vacuum suction head portion 10 having the dust suction hole 11 and the top part of the moisture cleaner device 50 is easily attachable and removable from connecting pipe 15 by a band 90 such that the moisture cleaner device is attached as shown at the rear of the vacuum suction head portion 10 and connecting pipe 15. Accordingly, moisture device 50 of the present invention can be mounted without enlargement of head portion 10 of the vacuum cleaner. The length of the moisture cleaner can be adjusted according to the length of the connecting pipe 15.

Figure 4:
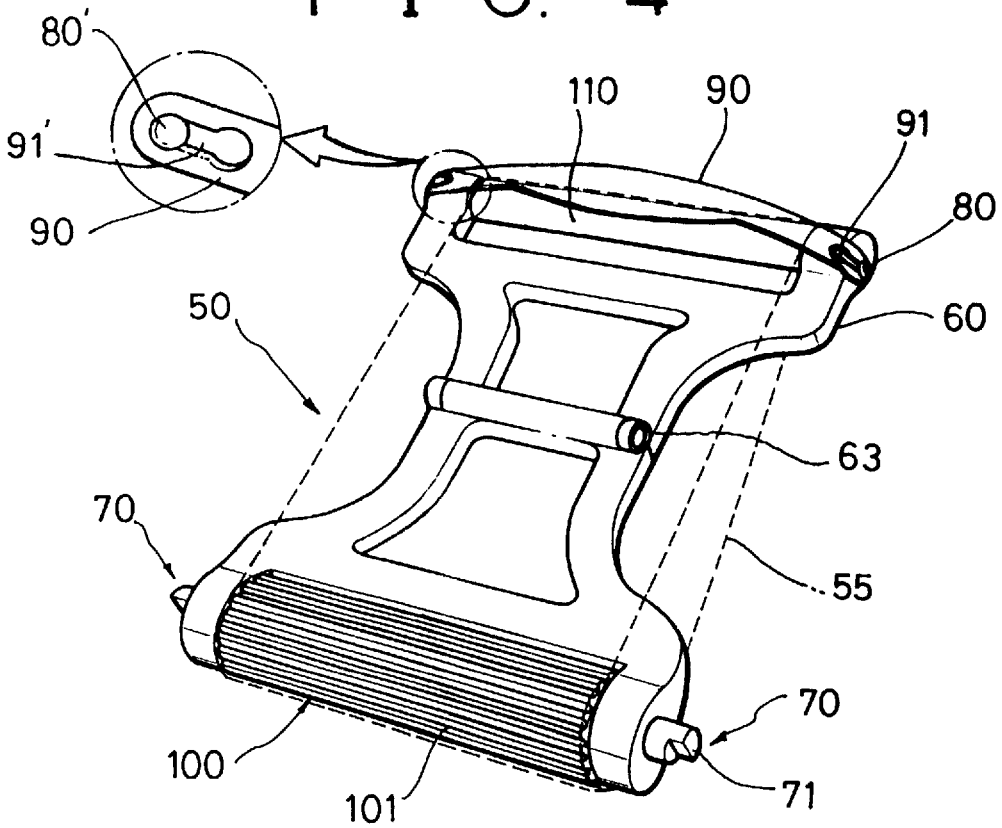
FIG. 4 is a view of the moisture cleaner device in accordance with the present invention.
Figure 5:
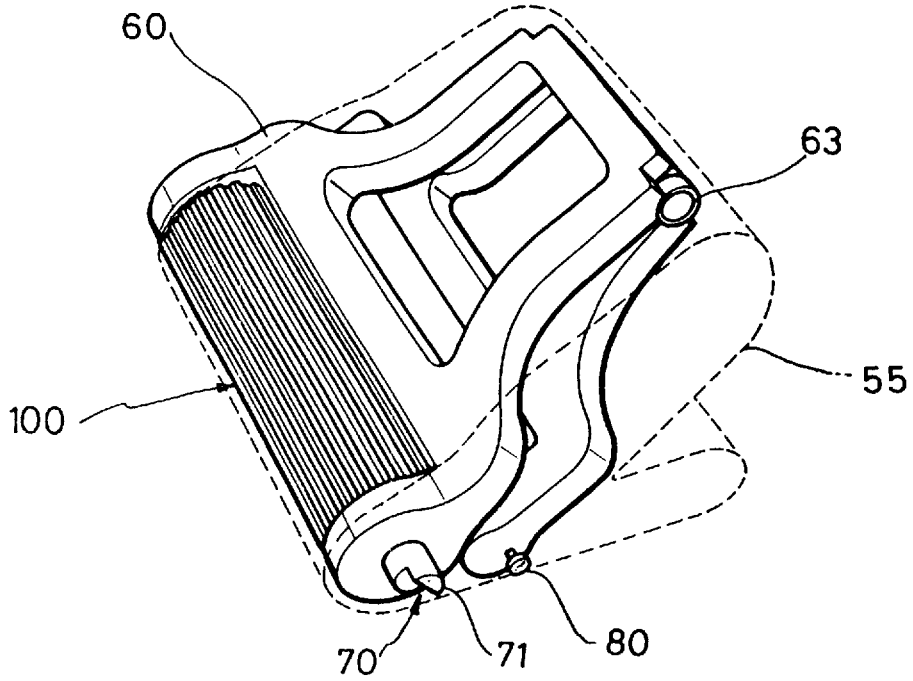
FIG. 5 is a view illustrating the folded moisture cleaner device shown in FIG. 4.

FIG. 4 shows the structure of the moisture cleaner device 50. Device 50 comprises a frame 60 which provides the circulation trajectory for the moisture cleaner 55, a pair of projections 70 connecting the lower part of the frame 60 to head portion 10, an expansive band 90 and a pair of coupling projections 80 which connect the top part of the frame 60 to the connecting pipe 15, working roller 100 and a driven roller 110 that causes the moisture cleaner 55 mounted on frame 60 to move along the surface of frame 60 together with the back and forth movement of head section 10. The working roller 100 is rotatable mounted sideways at the lower part of the frame 60 and the driven roller 110 is rotatable mounted sideways at the top part of the frame 60. Hinge member 63 is mounted sideways at the center of the frame 60 in order to enable removal of the moisture cleaner 55. As shown in FIG. 5, the top part and the lower part of the frame 60 can be folded and reduced to a small size by hinge member 63.

Figure 6:
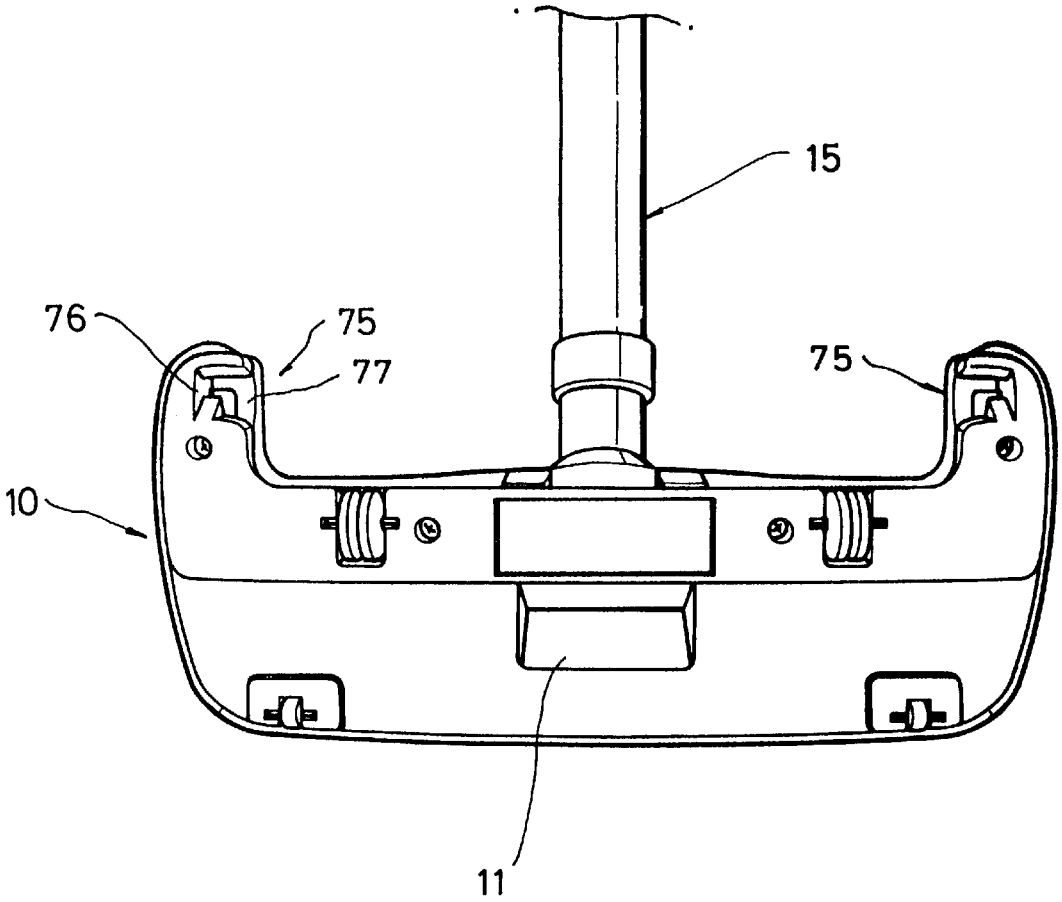
FIG. 6 is a bottom view of the dust suction hole of the vacuum cleaner in accordance with the present invention.

Projection members 70 are formed to protrudes from both sides of the lower part of frame 60. Each projection member 70 is cylindrical in shape such that top edge 71 is shaped, in cross section, as a semicircle. In order to receive projection members 70, grooves 75 are formed at the rear of the head portion 10 as shown in FIG. 6.

Groove 75 is composed of the open groove part 76 which has a wider groove than the semicircle formed on top edge 71 and interior grooves 77, shaped as a circular arc in open groove part 76.

Figure 8A:
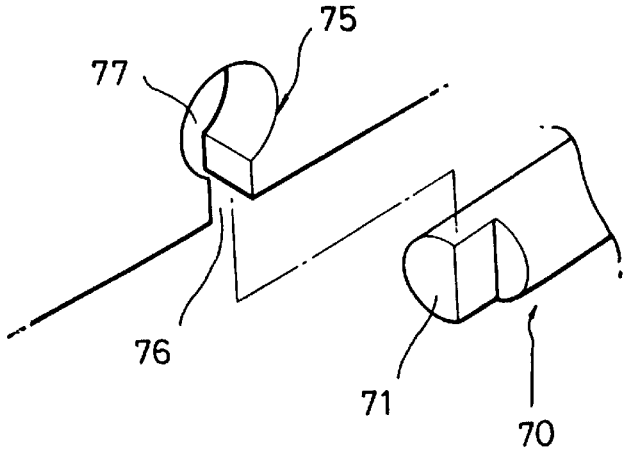
FIGS. 8A–8C are views illustrating the steps of connecting the moisture cleaner device to the suction dust hole.
Figure 8B:
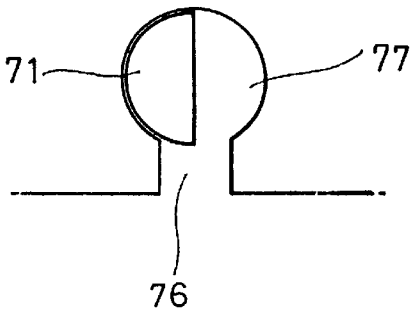
Figure 8C:
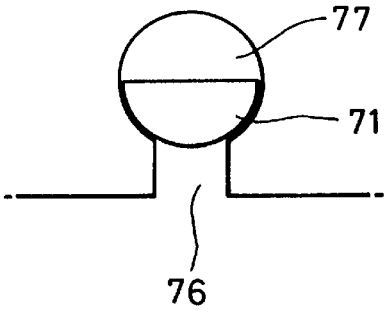

FIG. 8A through FIG. 8C illustrate the steps of connecting a projection member 70 and a groove 75. As shown in FIG. 8A, the top edge 71 of the projection member 70 is inserted into the interior groove 77 through the open groove part 76 of the groove 75.

If the moisture cleaner device 50 is attached, the projection member 70 rotates by 90° and the circular arc part of the top edge 71 in the projection member 70 is coupled to the interior groove 77 of the circular arc shape (FIG. 8C).

Figure 7:
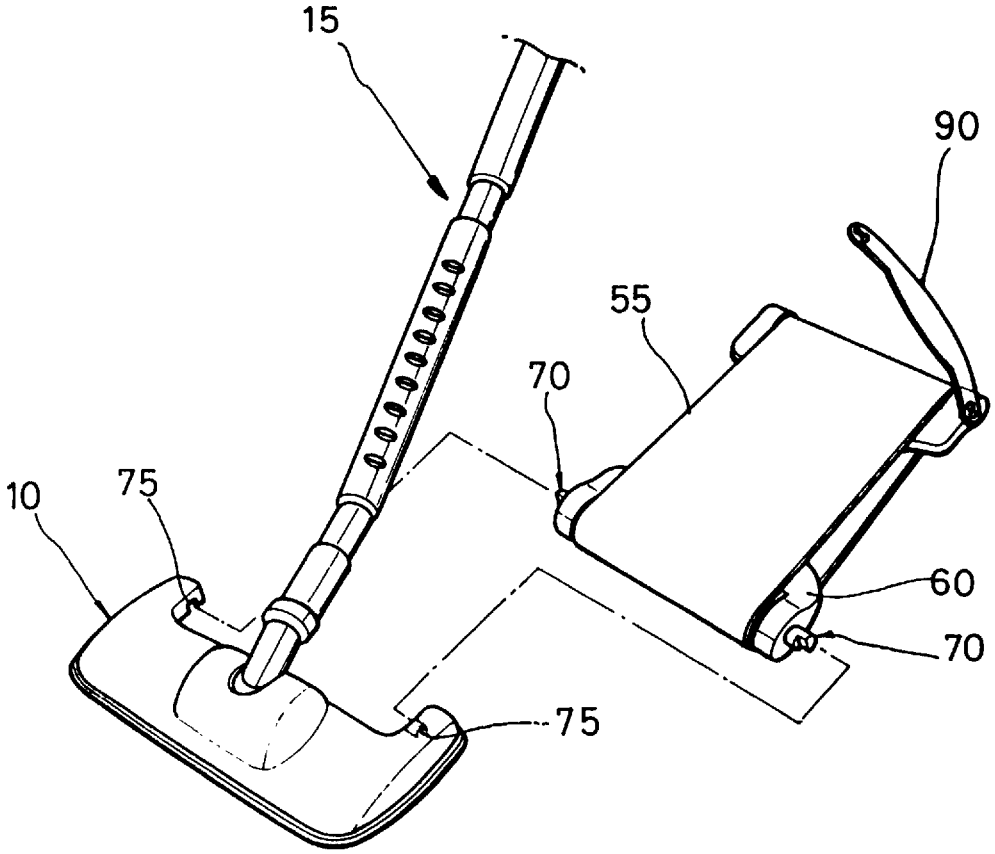
FIG. 7 is a perspective view illustrating the moisture cleaner device separate from the moisture cleaner.

As shown in FIG. 7, the band 90 which couples the top part of frame 60 to the connecting pipe 15 comprises elastic band 90, band 90 having a pair of coupling holes 91 and 91' at both edges (see FIG. 4). The coupling holes 91 and 91' are combined with the duplicate circular arc in which the inner circular arc has larger diameter than outer one. The diameter of the coupling projections 80 and 80' which are formed at the top part of frame 60 is adapted to fit into coupling holes 91 and 91', coupling holes 91 and 91' having two circular shaped openings at the edges as illustrated.

The process of connecting the outer circular arc of coupling hole 91' with the coupling projection 80' is as follows: the one coupling hole 91 of the elastic band 90 is connected to coupling projection 80, and the band 90 which is wrapped to the front of the connecting pipe 15 is slightly pulled and the inner circular arc of the other coupling hole 91' is inserted to the other coupling projection 80', and then the elastic band 90 is shortened to the original state, whereby the connection is completed.

As shown in FIG. 4, because the surface of the working roller 100 comprises a plurality of elongated members 101, when working roller 100 rotates according to the back and forth movement of the vacuum head suction portion 10, the moisture cleaner 55 which is inserted to the moisture cleaner device 50 also circulates on the surface of the frame 60 due to the unevenness of surface 101.

The moisture cleaner 55 can be made of cotton fabrics similar to a towel, the cotton fabrics being rolled up to form the ring shape illustrated. In addition, if a Velcro type attachable fabric is stuck to the edge of the cotton fabric, the attachment and removal of the moisture cleaner becomes easier.

If moisture cleaner 55 is attached to moisture cleaner device 50 such that the frame 60 is folded around the hinge member 63 as shown in FIG. 5 and the frame 60 is straightened in the original position shown in FIG. 4, the resultant circulation of the moisture cleaner 55 is completed by the rotation of the working roller 100 and the driven roller 110. In order to set up the moisture cleaner device 50 having the moisture cleaner 55 attached to the vacuum cleaner, moisture cleaner device 50 is positioned as shown in FIG. 7. If a pair of members 70 are fitted to the groove 75 which is formed at both sides of the rear of the vacuum suction head portion 10, the top edge 71 of the projection member 70 is located to pass through the open groove part 76 of the groove 75.

In this state, if the moisture cleaner device 50 is joined together with connecting pipe 15 after the projection members 70 are inserted into the inner grooves 77, the projection member 70 rotates and the circular arc part of the top edge of the top 71 is hooked to the open groove part 76, such that the lower part of the moisture cleaner device 50 is fixed to the vacuum suction head portion. This attachment process is illustrated in FIGS. 8A and 8C. When the lower part of the moisture cleaner device 50 is fixed, the coupling hole 91 formed in one edge of the band 90 receives the coupling projection 80 formed in one side of the top part of the frame 60. Next, when the band 90 is positioned in the front of the connecting pipe 15, the other edge of the band 90 is pulled and coupling projection 80 is inserted into the inner circular arc of the coupling groove 91' formed in the other edge in band 90. Thereafter, the elastic band 90 is reduced in size and the outer circular arc of the coupling groove 91', having a smaller diameter is fitted to the coupling projection 80' and, as shown FIG. 3, the top part of the moisture cleaner device 50 thus being fixed to the connecting pipe 15.

If the position of the coupling projections 80 and 80' and the coupling hole 91 and 91' are reversed, the effect is identical. If coupling projections 80 and 81' are located on the elastic band 90 and a pair of the corresponding coupling holes 91 and 91' are located at the top part of the frame 60, the top part of the moisture cleaner device 50 is fixed to the connecting pipe in an identical manner. A number of concave holes 16 are formed in the connecting pipe 15 (FIG. 3) which is joined to the elastic band 90, such that the band 90 is not removed from the connecting pipe 15 but connected for cleaning.

As shown in FIG. 3, if the vacuum cleaner which is equipped with moisture cleaner device 50 is used to clean the floor, the vacuum cleaning is conducted such that the dust hole 11, formed at the bottom of the vacuum suction head portion 10, initially encounters the floor and at the same time, the moisture cleaning is performed by the operative moisture cleaner device 50 thus reducing the cleaning time and labor. The process of the moisture cleaning is as follows: the head section 10 is moved back and forth, the working roller 100 and driven roller 110 are rotated, the moisture cleaner 55 is circulated and then the cleaner rubs the floor. The moisture cleaner 55 must be cleaned and separated from the device 50 when the cleaning is over and the moisture cleaner 55 become dirty.

In order to separate the moisture cleaner 55, the moisture cleaner device 50 first must be separated from the vacuum cleaner and the attachment process is then reversed.

Namely, one edge of the elastic band 90 is pulled slightly, and then is removed from the coupling projections 80 and 80' through the coupling holes 91 and 91'. After the top part of the moisture cleaner device 50 is separated from the coupling pipe 15, moisture cleaner device 50 is laid down on the floor. The projection member 70 is removed from the groove 75 of head section 10 and the moisture cleaner device 50 is then separated from the vacuum cleaner.

In this state, if the top and lower part of the frame 60 are folded about hinge member 63, the moisture cleaner 55 is separated from the moisture cleaner device 50. Of course, if the adhesive fabric of the Velcro type is attached to both edges of the moisture cleaner 55, the moisture cleaner 55 can be attached and removed without folding the frame 60.

As set forth hereinabove, the moisture cleaner device portion of the vacuum cleaner is vertically mounted in the rear of head section 10 so that the size and construction of the conventional head section 10 will not be changed allowing the corner section to be cleaned easily.

Because the attachment and removal of the moisture cleaner device is fast and easy, the cleaning work can be rapidly finished. The moisture cleaner cleaning or vacuum cleaning or a combination of these features can be used depending on the situation. In addition, the removal of the moisture cleaner is very easy such that the moisture cleaner can be cleaned at any time, whereby the room floor is cleaned more efficiently than prior art devices. The size of the moisture cleaner device can be varied using the connecting pipe since the overall configuration of the vacuum cleaner need not be changed, the consumer having the ability to select various moisture cleaner devices. In general, because manufacture and installation are simple, the cost of the moisture cleaner device of the present invention is reduced.

What is claimed is:

1. A vacuum cleaner having a moisture cleaner device comprising a primary body accommodating a motor fan and a filter to provide a vacuum suction; a dust vacuum suction head portion at the bottom of the body for sucking up dust on a floor; and a connecting pipe connecting the primary body to the dust suction head portion in which a top part and a lower part of the moisture cleaner are adapted to attach to and be removed from the connecting pipe and the dust suction head portion, the moisture cleaner being positioned external to said dust suction head portion.

2. A vacuum cleaner as in claim 1 in which the moisture cleaner comprises a frame for providing the circulation track of the moisture cleaner; a working roller mounted in the lower part of said frame; a driven roller mounted in the top part of said frame; the first coupling means for attachment and removal of the lower part of said moisture cleaner to said dust suction head portion; and second coupling means for attachment and removal of the top part of said moisture cleaner to said connecting pipe.

3. A vacuum cleaner as in claim 2 in which the top and lower part of said frame are composed of a hinge member mounted in the center of the frame for attachment and removal of said moisture cleaner, the hinge member enabling the moisture cleaner to be folded.

4. A vacuum cleaner as in claim 2 in which the peripheral surface of said working roller is cylindrically shaped and has an uneven surface such that the moisture cleaner moves around between said working roller and said driven roller.

5. A vacuum cleaner as in claim 2, in which said first coupling means comprises a projection member which extends from both lower part sides of said frame and which has a cylindrical shape in order that the top part edge has a semicircle cross-section shape and a groove part formed at said dust suction head portion in order to accommodate said projection member, said groove part being composed of an open groove part and a interior groove part, the top part edge of said projection member passing through the open groove of the groove part when the moisture cleaner is attached, the top part edge moving down the interior groove such that the lower part of said frame can be attached and removed easily from said dust suction head portion.

6. A vacuum cleaner as in claim 2 in which said second coupling means is composed of a coupling projection formed at both top part sides of said frame and an expansive band formed with coupling holes at both edges thereof in order to insert said coupling projection therein whereby the coupling projection is inserted into said coupling hole such that the top part of said frame is removably mounted to the connecting pipe.

* * * * *

UNITED STATES PATENT AND TRADEMARK OFFICE

CERTIFICATE OF CORRECTION

PATENT NO. : 5,857,239

DATED : January 12, 1999

INVENTOR(S) : Jang Keun Oh et al.

It is certified that error appears in the above-identified patent and that said Letters Patent is hereby corrected as shown below:

Title page, Item [75], "Assignee", delete "Kwanju" and insert --Samsung Kwang-ju-- therefor.

Signed and Sealed this

Twentieth Day of July, 1999

*Attest:*

Q. TODD DICKINSON

*Attesting Officer*

*Acting Commissioner of Patents and Trademarks*